US005333758A

United States Patent [19]

Jamison et al.

[11] Patent Number: 5,333,758

[45] Date of Patent: Aug. 2, 1994

[54] MULTI-OUTLET FLUID DISPENSER POUCH

[75] Inventors: Mark D. Jamison, Zion, Ill.; Stewart Banks, Brantford; Nicholas Williamson, Burington, both of Canada; George W. Roders, Kenosha, Wis.

[73] Assignee: Marlingford Holdings Limited, Guernsey, Channel Islands

[21] Appl. No.: 257

[22] Filed: Jan. 4, 1993

[51] Int. Cl.[5] ..... B65D 35/28

[52] U.S. Cl. ..... 222/101; 222/214; 222/491; 383/906

[58] Field of Search ..... 222/107, 214, 94, 105, 222/491, 494, 101; 206/484; 383/93, 906

[56] References Cited

U.S. PATENT DOCUMENTS 4,491,245 1/1985 Jamison .
4,564,127 1/1986 Garabedian et al. .
4,793,121 12/1988 Jamison .
4,890,744 1/1990 Lane, Jr. et al. ..... 206/484 X
4,935,283 6/1990 Jamison .
5,000,350 3/1991 Thomsen .
5,018,646 5/1991 Billman et al. .
5,067,635 11/1991 Thomsen ..... 222/107 X

*Primary Examiner*—Gregory L. Huson
*Attorney, Agent, or Firm*—Ladas & Parry

[57] ABSTRACT

A pliable, fluid dispensing pouch is provided which includes a flexible shot-chamber having at least two narrow spaced tortuous fluid pathways each leading to a separate discharge opening at one end of the pouch. The discharge openings are initially sealed closed by the presence of a sealing tab. The discharge openings are unsealed by tearing off the tab. The separate discharge openings are of a diameter suitable to prevent fluid from being hand or finger squeezed out of the pouch once the tear tab has been detached.

11 Claims, 5 Drawing Sheets

MULTI-OUTLET FLUID DISPENSER POUCH

FIELD OF THE INVENTION

The present invention relates to fluid pouches for holding and dispensing fluids such as liquid cleaning agents, foodstuffs, and the like.

BACKGROUND OF THE INVENTION

This invention relates to improved fluid pouches and associated fluid dispensers. In particular, this invention relates to flexible fluid pouches for holding fluids such as liquid detergents and foodstuffs and having a tortuous discharge outlet passageway. An example of a flexible pouch of this nature is disclosed in U.S. Pat. No. 4,491,245. The pouch disclosed in this patent has an outlet passageway having a serpentine geometry such that fluid is prevented from freely flowing out of the pouch but can be expelled using hand or finger pressure.

A drawback to these fluid pouches are that they are prone to leaking a small amount of residual fluid in use when being handled and while this is no doubt advantageous for many applications, there are other applications where this is not desirable. Leakage also poses a problem particularly when removing empty or near empty pouches containing a small amount of residual fluid which can spill causing a mess.

Accordingly, it would be advantageous to provide a fluid pouch which will not expel fluid under hand or finger pressure alone when the pouch is opened and requires pressure to be applied to the pouch using a mechanical compression means to expel liquid therefrom.

SUMMARY OF THE INVENTION

The subject invention provides a pliable, flexible fluid pouch for storing liquids therein. The pouch comprises flexible, liquid impermeable superposed sheets each having a peripheral edge. The superposed sheets are attached together in liquid-tight relation along the peripheral edges to enclose therebetween a liquid storage compartment and a flexible shot-chamber in flow communication with the liquid storage compartment. The pouch includes at least two spaced, serpentine outlet passageways each extending from the flexible shot-chamber to an associated liquid discharge opening located at the peripheral edge of the sheets. The pouch includes a detachable closure member attached to the pouch for blocking the discharge openings prior to use of the pouch for dispensing liquids therefrom. The serpentine outlet passageways have a suitable tortuosity so that liquid does not leak out of the opened pouch until pressure is applied to the pouch. The serpentine outlet passageways are suitably sized so that finger or hand pressure alone is generally not sufficient to expel fluid from the pouch.

In another aspect of the invention there is provided a fluid pouch having a storage compartment and a flexible shot-chamber. The pouch is used to store liquid which is to be dispensed from a dispenser which comprises a dispenser station through which the fluid is to be dispensed along a dispenser path that extends therethrough. The dispenser includes a backstop on one side of the dispenser path and a cam means confronting the backstop and located on the other side of the dispenser path. The dispenser includes manual activation means for actuating the cam means to move the cam means downwardly along a backstop with the flexible shot-chamber between the cam means and the backstop to expel a quantity of fluid from the dispenser. The improvement of the fluid pouch comprises the flexible shot-chamber of the fluid pouch having at least two spaced tortuous fluid pathways each leading to a separate discharge opening at the peripheral edge of the pouch.

BRIEF DESCRIPTION OF THE DRAWINGS

The following is a description, by way of example only, of the multi-outlet fluid pouch forming the present invention, reference being had to the drawings, in which.

DETAILED DESCRIPTION OF THE INVENTION

Figure 1:
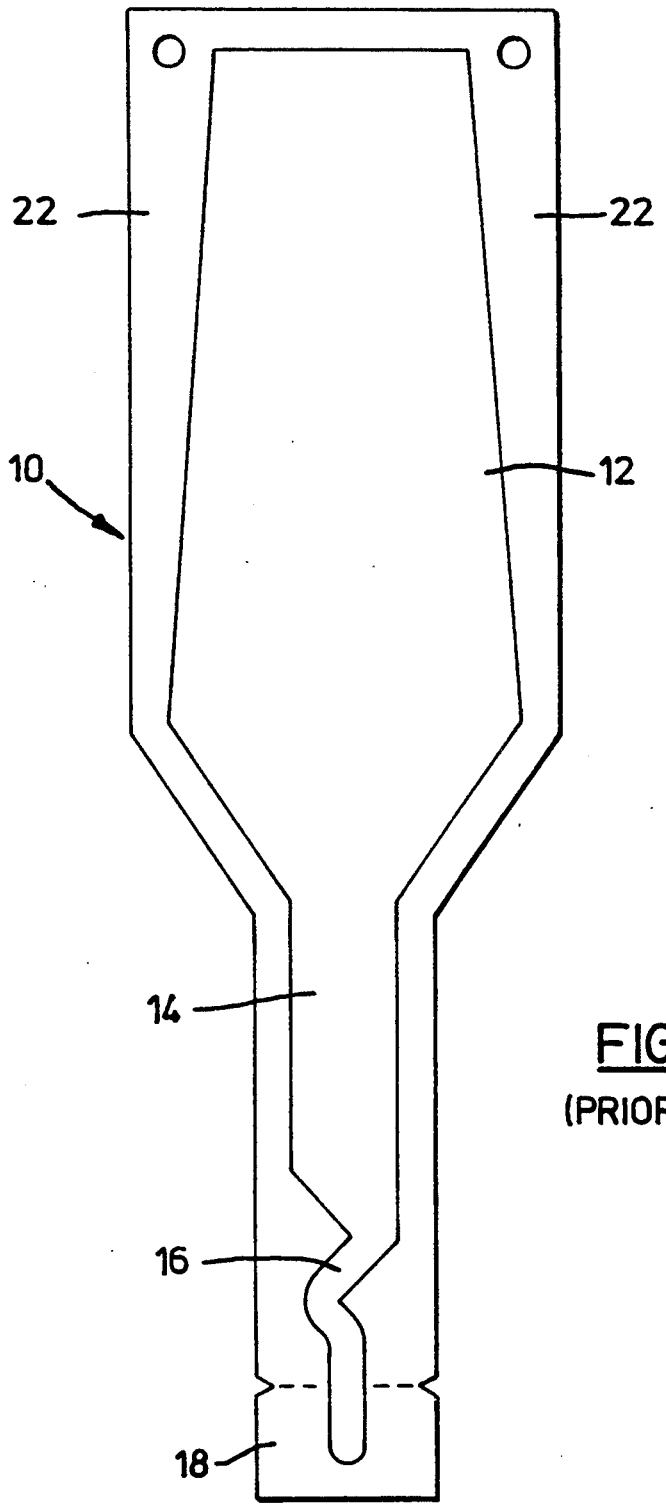
FIG. 1 (PRIOR ART)
FIG. 1 is a plan view of a prior art flexible fluid pouch.

Referring to FIG. 1, a prior art fluid pouch 10 comprises two flexible plastic sheets sealed together along the edges thereof to define a main storage compartment 12, a lower flexible shot-chamber 14 in flow communication with compartment 12, and a discharge outlet 16 that extends along a tortuous or serpentine path, similar to the pouch taught in U.S. Pat. No. 4,491,245. The geometry of the discharge passageway is chosen to ensure fluid in the pouch does not discharge through the discharge opening formed when tear tab 18 is removed unless hand or finger pressure is applied to the pouch.

Figure 2:
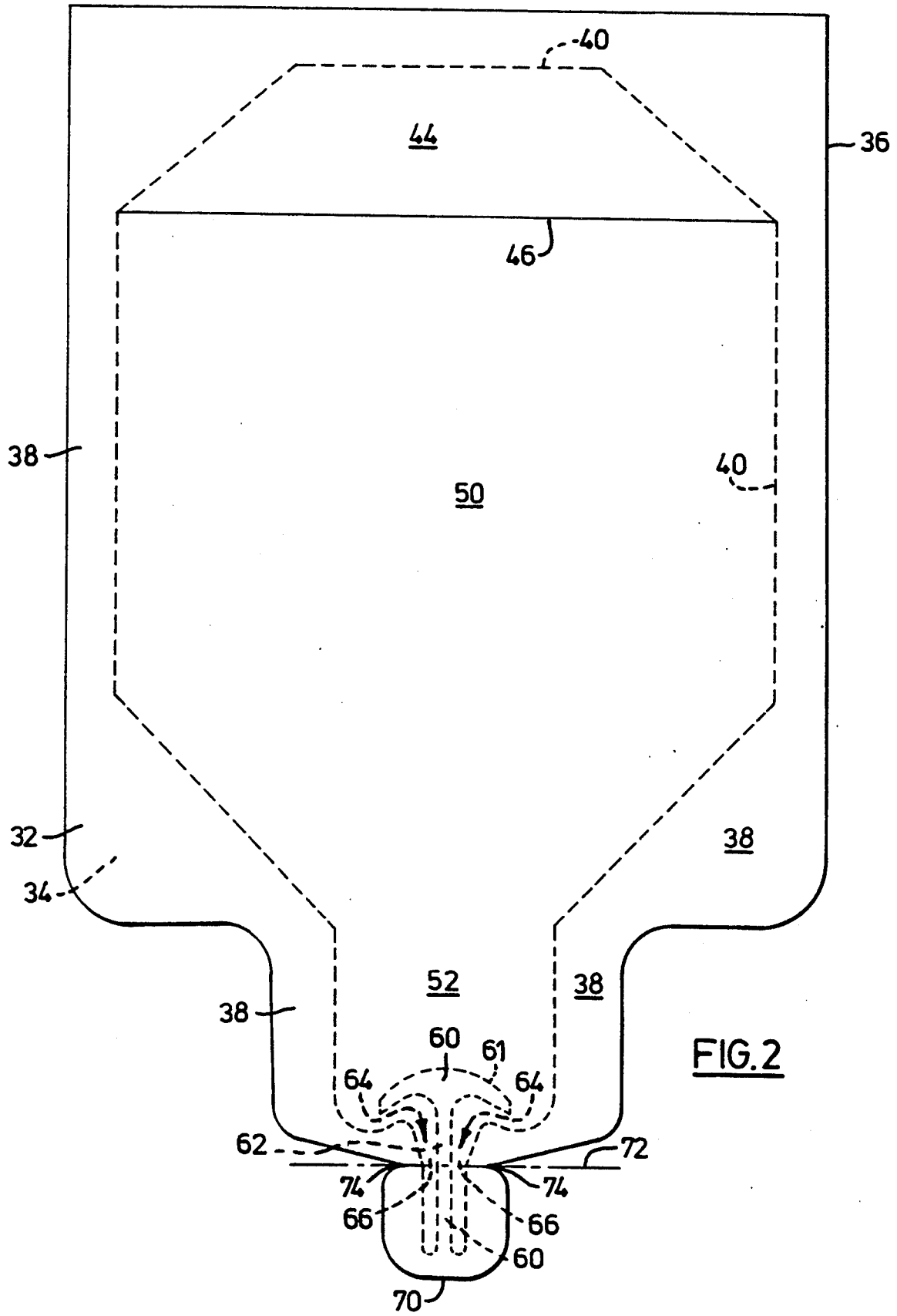
FIG. 2 is a plan view of a fluid pouch fabricated in accordance with the present invention.
Figure 3:
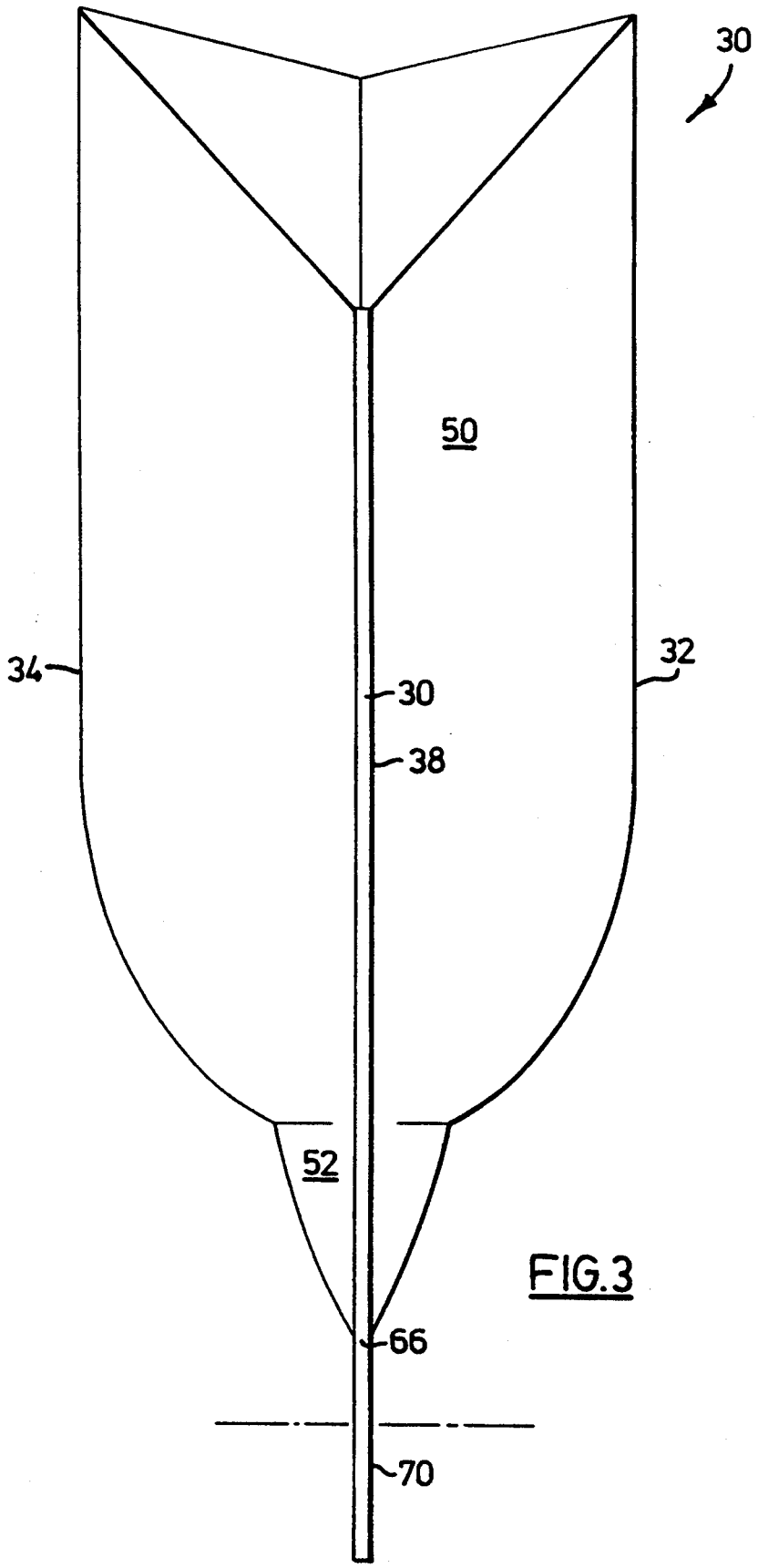
FIG. 3 is a side elevational view of the pouch of FIG. 2 filled with fluid.

Referring to FIGS. 2 and 3, a pliable fluid pouch 30 forming the subject invention comprises two liquid impermeable, flexible superposed sheets 32 and 34 having peripheral edges 36 and fabricated of a flexible sheet material such as plastic wherein the two sheets are in overlaying relationship. Sheets 32 and 34 are fabricated of a tear and puncture resistant material. Sheets 32 and 34 are sealed together along a peripheral boundary region 38 located between edges 36 of the sheets and a broken line 40 spaced inwardly from edge 36. Pouch 30 in the empty state as illustrated in FIG. 2 is gusseted at the upper end 42 thereof in the area 44 bounded by solid line 46 and broken line 40. The two sheets 32 and 34 sealed together define a flexible, main storage compartment 50 which is tapered at its lower end and which is in flow communication with a lower, flexible shot-chamber 52.

Sheets 32 and 34 are sealed together at the lower end of flexible shot-chamber 52 thereby defining an integrally formed and generally T-shaped fluid control means 60 having a curved abutment portion 61 and a stem portion 62. The fluid control means 60 together with the peripheral seal between the sheets 32 and 34, as depicted by the broken line 40 on either side of the fluid control means 60, define a pair of spaced, narrow and symmetric discharge passageways 64 that extend along two tortuous paths from the bottom of flexible shot-chamber 52 to a pair of discharge openings 66. As shown in FIG. 2, dual passageways 64 are symmetric with respect to fluid control means 60. The curved abutment portion 61 assures that upon pressure being applied to the flexible shot-chamber 52 there is an even distribution of liquid flow and hydrostatic pressure in the shot-chamber 52 and in the discharge passageways 64.

Figure 4:
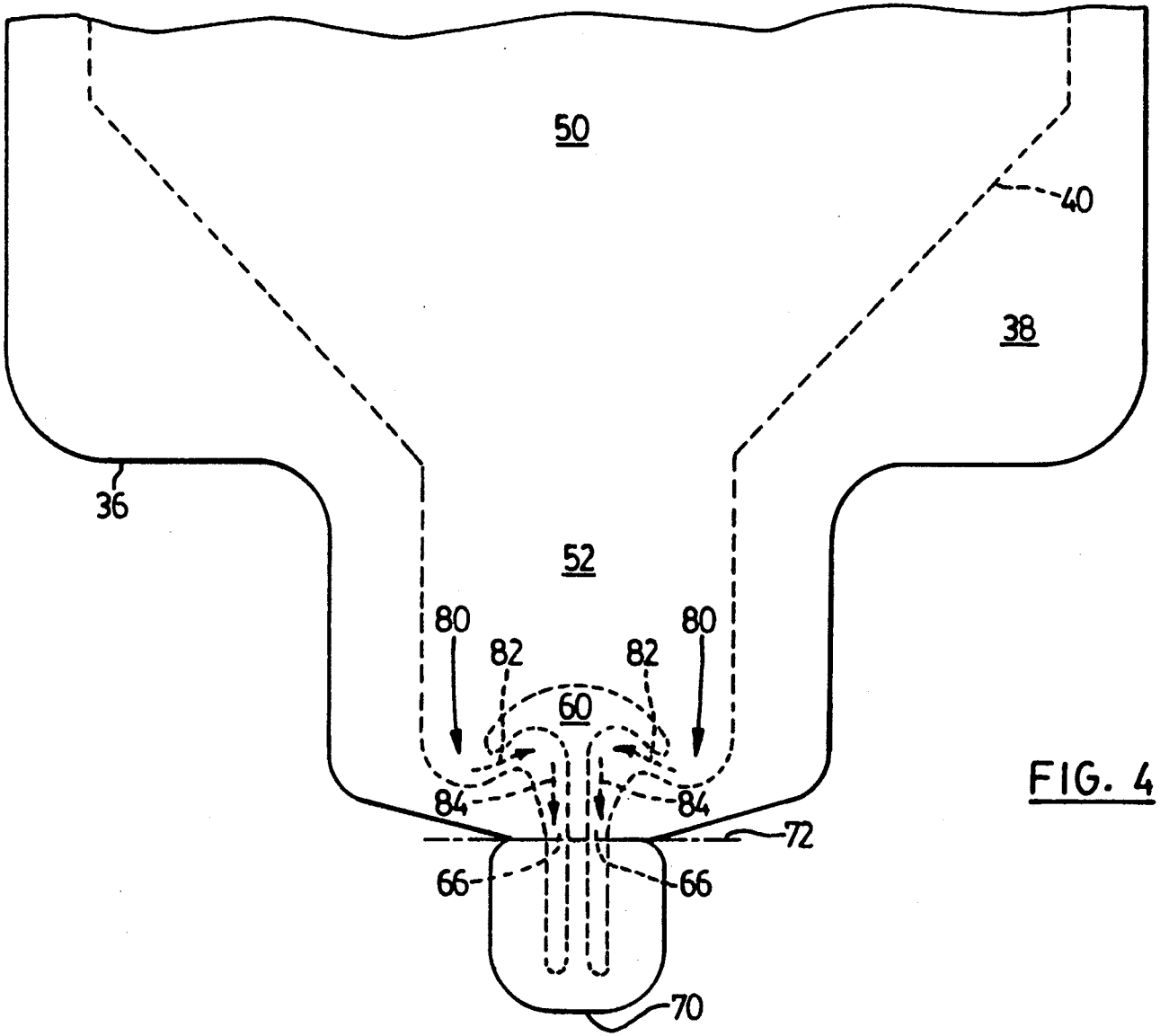
FIG. 4 is a more detailed view of the shot-chamber of the pouch of FIG. 2.

As shown in FIGS. 2 and 4, pouch 30 is still intact but before commencement of use, the bottom end of the pouch comprising a tear tab 70 will be severed along a tear line collinear with line 72 joining a pair of spaced notches 74 to open discharge openings 66.

Referring to FIG. 4, the flow path of the liquid from shot-chamber 52 is first downwardly in the direction of arrows 80, then upwardly and inwardly in the direction of arrows 82 and then downwardly in the direction of arrows 84. With this outlet passageway geometry, liquid will not flow out through passageways 64 unless pressure is applied to shot-chamber 52. Further, the dimensions of passageways 64 are chosen such that significant mechanical pressure must be applied to shot-chamber 52 in order to expel fluid therefrom when the pouch is opened.

Thus, passageways 64 are each narrower than would be the preferred diameter of a single outlet passageway as would normally be used in the pouch. This, coupled with the viscous nature of the liquid normally dispensed from pouch 30 and because of the tortuous path of discharge passageways 64, the liquid in the pouch is not readily dispensed therefrom using hand or finger pressure alone. Dispensing fluid from pouch 30 comprised of the dual outlet serpentine passageways 64 requires the application of pressure to the shot-chamber using mechanical means. Thus pouch 30 may be used in any one of currently known fluid dispensing systems comprising a fluid dispenser having rollers or swash plates designed to apply mechanical pressure to flexible shot-chamber 52. Shot-chamber 52 is dimensioned to hold a predetermined amount of fluid therein so that a predetermined dose of fluid can be expelled from pouch 30. This is usually accomplished by the fluid dispenser having a discharge compartment in which the swash plate or roller engages the pouch at the top of shot-chamber 52 thereby pinching off the shot-chamber 52 from storage compartment 50 with a predetermined charge of fluid trapped in shot-chamber 52. Further action of the swash plate or roller coupled to the dispenser acts to expel the predetermined charge of fluid out of shot-chamber 52 through outlets 66.

Figure 5:
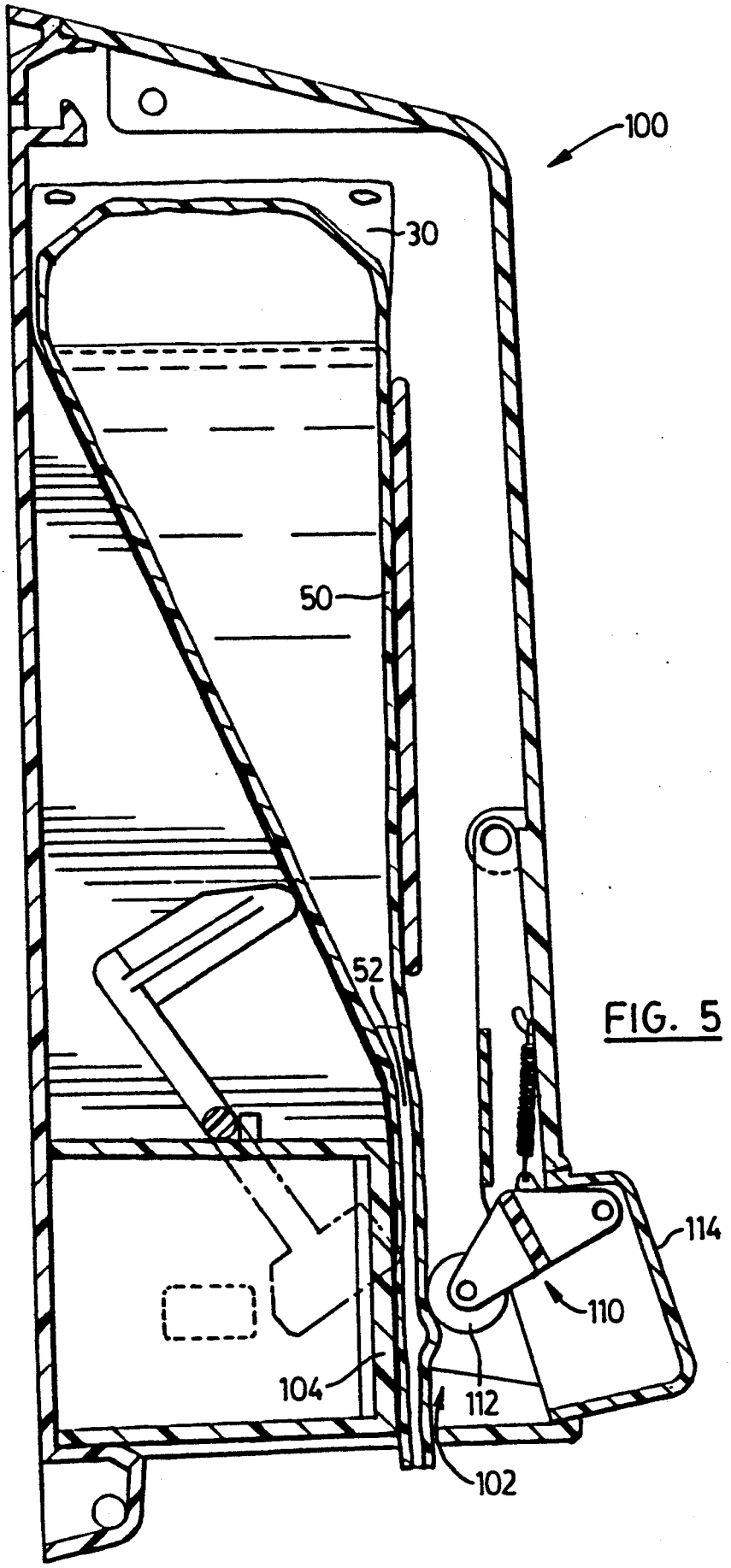
FIG. 5 is a sectional side view of a non-limiting representative fluid dispenser which may be used in conjunction with the fluid pouch of the present invention.

Referring to FIG. 5, a non-limiting example of a fluid dispenser 100 for dispensing a fluid from dispenser pouch 30 comprises a dispenser station through which the fluid is to be dispensed along a dispenser path 102 that extends therethrough, a backstop 104 on one side of the dispenser path, a cam means 110 shown comprising a roller 112 confronting backstop 104 and located on the other side of dispenser path 102, a pushbutton 114 for actuating cam means 110 to move said cam arcuate face portion downwardly along said backstop with flexible shot-chamber 52 between cam 110 and backstop 104 to expel a quantity of fluid from dispenser 100.

It will be understood by those skilled in the art that the rate of fluid discharge from pouch 10 having two discharge pathways may be the same as the volume fluid discharge from a pouch having a single discharge pathway having larger mean radius. For example, consider a fluid pouch having a single discharge pathway of mean radius R and a fluid pouch such as disclosed herein having two outlet passageways each of radius r, where $r<R$. Assuming the three discharge passageways are of the same length, then to a first approximation, for both pouches to have the same rate of fluid discharged requires the total volume of discharge pathway to be the same. This results in the relation of $R=\sqrt{2}r$ relating the radii of the passageways in the two pouches. It will also be appreciated by those skilled in the art that this principle could be extended to the case of more than two discharge passageways. For fairly viscous liquids such as mustard and ketchup, two discharge passageways may be sufficient. However, for less viscous fluids such as certain detergents and soaps, more than two outlet passageways may be desirable each having a radius smaller than the radius of the passageway of the dual outlet pouch.

The pliable pouch with the multi-discharge outlet passageways disclosed herein is advantageous in that finger or hand squeezing of the pouch with tab 70 detached therefrom does not provide sufficient pressure to expel fluid from the open pouch. This is convenient in that it reduces considerably the chance of spillage of fluid removing the near empty pouch from a dispenser. It also allows partially filled, open pouches to be conveniently handled and transported without spillage. A further advantage of the pouch provided with the narrow dual outlet passageways requiring mechanically applied pressure to eject fluid is that several such pairs may be incorporated into a larger pouch. Fluid may be separately dispensed from several of the dual passageways without fear of spillage during handling with the pouch opened. An advantage of the outlet passageways being symmetrically disposed about fluid control means 60 is that the roller or swash plate used in the dispenser to expel the fluid contacts a shot-chamber 52 having a uniform fluid distribution thereacross. This provides for uniform and smooth discharge of liquid since the roller or swash plate rides evenly down the dispenser compartment. Pouches having a single non-symmetric discharge passageway sometimes suffer from uneven expulsion of liquid due to the roller or swash plate riding unevenly down the dispenser compartment.

Thus, while the pliable fluid pouch having narrow, dual tortuous outlet passageways which require the application of pressure using mechanical compression to expel fluid therefrom has been described and illustrated with respect to the preferred and alternative embodiments, it will be appreciated that numerous variations of these embodiments may be made without departing from the scope of the invention disclosed herein.

We claim:

1. A pliable fluid pouch for storing liquids therein, comprising flexible, liquid impermeable superposed sheets being sealed together in liquid-tight relation to enclose therebetween a liquid storage compartment and a flexible shot-chamber in flow communication with said liquid storage compartment, including at least two spaced, serpentine outlet passageways each extending from said flexible shot-chamber to an associated liquid discharge opening located at the peripheral edge of said liquid tight seal, said at least two spaced serpentine outlet passageways each including a passageway portion extending substantially upwardly and away from said associated liquid discharge opening, including detachable closure means attached to said pouch for blocking said discharge openings prior to use of said pouch, and wherein said serpentine outlet passageways are suitably sized so that finger or hand pressure alone is generally not sufficient to expel fluid from said pouch.

2. The fluid pouch according to claim 1 wherein said superposed sheets each have a peripheral edge, said superposed sheets being attached together along said peripheral edges to form said liquid tight seal, said associated discharge openings being located at the peripheral edges of said sheets.

3. The fluid pouch according to claim 1 or 2 wherein said at least two spaced, serpentine outlet passageways comprise a pair of outlet passageways symmetrically disposed with respect to said flexible shot-chamber, said pair of outlet passageways being separated by opposing portions of said superposed sheets adjacent a portion of the peripheral edges of said sheets being sealed together.

4. The fluid pouch according to claim 1 or 3, comprising an integrally formed fluid control means provided in the shot-chamber, the fluid control means being generally T-shaped with, the upright section of said T-shaped fluid control means providing a generally curved abutment portion facing the storage compartment and the transverse section of the T-shaped fluid control means providing a stem portion extending away from said abutment portion towards the discharge opening, said stem portion forming a part of the outlet passageways.

5. The fluid pouch according to claim 4 wherein said flexible shot-chamber is sized to hold therein a predetermined amount of liquid.

6. The fluid pouch according to claim 4 wherein said detachable closure means comprises a tear tab attached to a portion of the peripheral edge adjacent said discharge openings along a weakened line.

7. In a fluid pouch having tow superposed sheets sealed together in liquid tight relation to form a flexible storage compartment in flow communication with a flexible shot-chamber for dispensing a fluid from a dispenser which comprises, a dispenser station through which the fluid is to be dispensed along a dispenser path that extends therethrough, backstop on one side of the dispenser path, cam means confronting the backstop and located on the other side of the dispenser path, means for actuating said cam means to move said cam means downwardly along said backstop with sad flexible shot-chamber positioned between said cam means and said backstop to expel a quantity of fluid from said dispenser, the improvement of the fluid pouch comprising at least two spaced serpentine outlet passageways each leading from the flexible shot-chamber to a separate associated discharge opening at a peripheral edge of said pouch, said at least two spaced serpentine outlet passageways each including a passageway portion extending substantially upwardly and away from said associated liquid discharge opening, and wherein said serpentine outlet passageways are suitably sized so that finger or hand pressure alone is generally not sufficient to expel fluid from said pouch.

8. The fluid pouch according to claim 7 wherein said at least two spaced, serpentine outlet passageways comprise a pair of outlet passageways symmetrically disposed with respect to aid flexible shot-chamber, said pair of outlet passageways being separated by opposing portions of said superposed sheets adjacent a portion of the pouch edge being sealed together.

9. The fluid pouch according to claim 7 or 8, comprising an integrally formed fluid control means provided in the shot-chamber, the fluid control means being generally T-shaped with, the upright section of said T-shaped fluid control means providing a generally curved abutment portion facing the storage compartment and the transverse section of the T-shaped fluid control means providing a stem portion extending away from said abutment portion towards the discharge opening, said stem portion forming a part of the outlet passageways.

10. The fluid pouch according to claim 9 wherein said flexible shot-chamber is sized to hold therein a predetermined amount of liquid.

11. The fluid pouch according to claim 10 wherein said detachable closure means comprises a tear tab attached to a portion of the peripheral edge adjacent said discharge openings along a weakened line.

* * * * *